US005779603A

United States Patent [19]

Nusbaum

[11] Patent Number: 5,779,603

[45] Date of Patent: Jul. 14, 1998

[54] HANDS-FREE HANDWEIGHTS

[75] Inventor: Neil Nusbaum, Culver City, Calif.

[73] Assignee: Hollywood Engineering, Inc., Compton, Calif.

[21] Appl. No.: 795,235

[22] Filed: Feb. 10, 1997

[51] Int. Cl.[6] ..... A63B 21/065

[52] U.S. Cl. ..... 482/105

[58] Field of Search ..... 482/105, 44, 79, 482/139, 74, 92, 93; D21/198

[56] References Cited

U.S. PATENT DOCUMENTS

| | | | |
|---|---|---|---|
| 4,247,097 | 1/1981 | Schwartz | 482/105 |
| 4,546,495 | 10/1985 | Castillo | 482/105 |
| 4,556,215 | 12/1985 | Tarbox et al. | 482/105 |
| 4,575,075 | 3/1986 | Tarbox et al. | 482/105 |
| 4,700,943 | 10/1987 | Widinski et al. | 482/79 |
| 5,300,000 | 4/1994 | Schwartz | 482/105 |

*Primary Examiner*—Stephen R. Crow
*Attorney, Agent, or Firm*—Fish & Richardson P.C.

[57] ABSTRACT

A device for attaching weights to a user's hands and/or wrists during exercise without occupying the user's fingers and thumbs. A thumb anchoring element, an adjustable palm attachment, and an adjustable wrist attachment are implemented to securely attach the device to a user. The device has a handweight compartment or/and a wristweight compartment to accommodate adjustable weights to the user's liking.

19 Claims, 4 Drawing Sheets

HANDS-FREE HANDWEIGHTS

FIELD OF THE INVENTION

The present invention relates to the field of exercise equipment. More particularly, the present disclosure describes a system for attaching weights to a person during exercise while leaving the user's hands free.

BACKGROUND AND SUMMARY OF THE INVENTION

Use of additional weights attached to a moving body part during exercise can be beneficial to a user by increasing the work required to do a task. Many weight attaching systems thus have been developed. One type of popular system is to provide weights on user's hands and/or arms.

Conventional hand-held weights, such as dumbbells, can be used. However, this occupies the hands of a user and prevents the user from holding other things. Hand-held weights can also cause the user's hand to tire.

Various "hands-free" weights for hands and arms have been developed to substitute hand-held weights for some exercise activities. One prior-art system includes wrist weights that are attached to a person's wrists by using wrist bands. However, such wrist weights, including adjustable wrist weights, can have a tendency to slip and move about on the arms. This can cause chafing and discomfort to a user.

It is therefore one object of the present invention to comfortably and securely attach weights to a user's hands and wrists without slippage during exercise while keeping the user's thumbs and fingers free.

It is another object of the present invention to provide a "one-size-fits-all" system in which the weight attachment is adjustable for various hand sizes and for comfort.

Another issue is the determination of the proper amount of weights to use for a user. One unique feature of the preferred embodiment of the present invention is implementation of adjustable weights so that a user can vary the amounts of attached weights according to one's physical condition and/or exercise needs.

One preferred embodiment of the hands-free weights includes a flexible base, at least one weight compartment disposed in an appropriate position in the base to hold weights, a thumb attachment to anchor the base to the thumb, a palm attachment for fastening the base to the palm, and a wrist attachment for further securing the base to the wrist. The weight compartment preferably locates either on the back of the user's hand or the user's wrist if the weights are worn properly. Alternatively, the preferred embodiment can have two weight compartments with one located on the wrist area and one on the back of the hand.

BRIEF DESCRIPTION OF THE DRAWINGS

These and other advantages of the present invention will become more apparent in the light of the following detailed description of preferred embodiments thereof, as illustrated in the accompanying drawings, in which.

DESCRIPTION OF THE PREFERRED EMBODIMENTS

Figure 1:
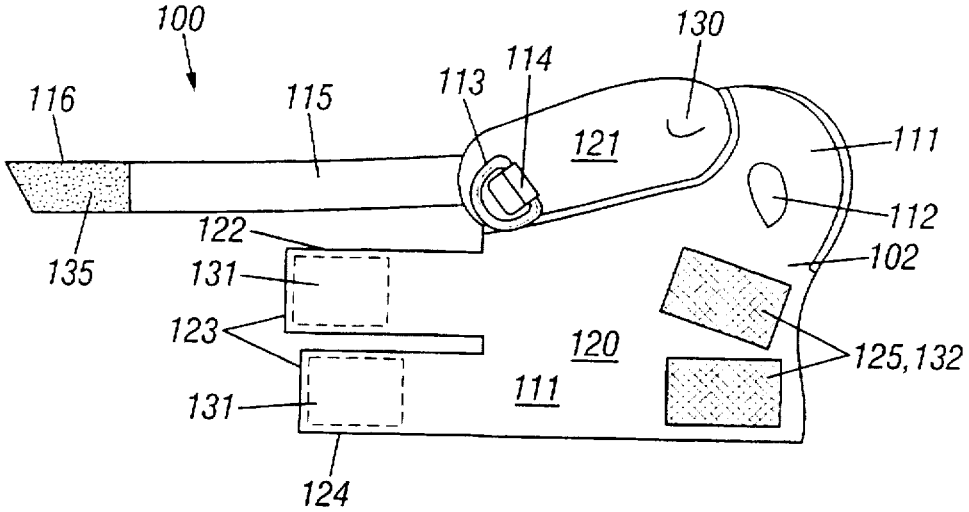
FIG. 1 shows the first preferred embodiment of the hands-free weight system with a hand weight compartment (left hand only).
Figure 2A:
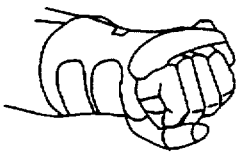
FIGS. 2*a*–2*f* illustrate how the hands-free weight system be worn.
Figure 2B:
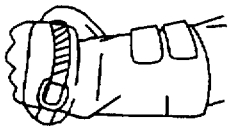
Figure 2C:
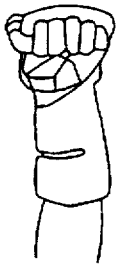
Figure 2D:
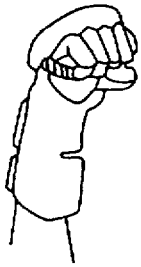
Figure 2E:
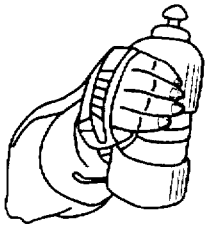
Figure 2F:
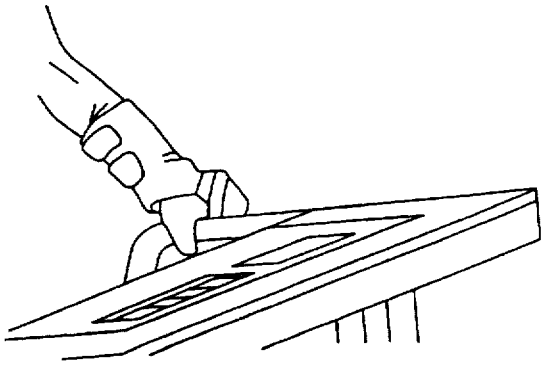

FIG. 1 shows the first preferred embodiment of the hands-free weight system 100 for the left hand. A right-handed system is substantially similar. A flexible supporting portion 102 has an inner surface and an outer surface. The inner surface is against the hand of a user when the hands-free weight system is worn in its intended manner. FIG. 1 shows only the outer surface. The supporting portion 102 has a hand portion 110 to fit mainly on the back of a user's hand and a wrist portion 120 to wrap around the wrist. Many flexible materials can be used for the supporting portion 102 including neoprene, leather, and nylon.

A thumb attachment 111 in the hand portion 110 is formed from a thumb hole 112 having inner surfaces through which the thumb protrudes. Alternatively, the thumb attachment 111 can be formed by a flexible thumb strap attached to the hand portion with a fastening mechanism. Thus, the thumb strap can be wrapped around the thumb and fastened. A flexible strap 115 and a "D"-shaped ring 113, both fixed to the hand portion 110 relative to each other, form a palm attachment. The D-ring 113 is attached to the hand portion 110 with a D-ring grommet 114. The outer surface of the strap 115 has a VELCRO-type loop and a VELCRO-type hook 116 at the end so that the strap 115 can be wrapped around the palm and fastened to the D-ring 113, thereby securing the hand portion 110 to the back of the user's hand. The tightness of the strap 115 can be varied at a user's will by adjusting the attachment position of the VELCRO-type hook 116 on the strap 115.

The wrist portion 120 includes two straps 122 and 124, both with a VELCRO-type hook 123 at the end of the inner surface side. Two VELCRO loop pieces 125 are attached to outer surface of the wrist porion 120 so that the two straps 122 and 124 can be wrapped around the wrist and fastened. This forms an adjustable wrist attachment with a range determined by the dimension of the hook/loop pieces.

A weight compartment 130 is disposed in the hand portion 110 in the first preferred embodiment 100. The weight compartment is configured to allow weight therein to evenly distribute, thus resulting in a balanced feel and comfort for the user. The amount of weight in the compartment 130 can be varied according to the user's needs. A number of approaches can be used to implement the adjustment of the attached weight. For example, a plurality of sets of weight patches with different weights can be used for this purpose.

FIGS. 2*a*–2*f* show how the hands-free weight system 100 is worn in its intended manner. The thumb attachment 111 anchors the device 100 relative to the thumb so that movements on the hand and arm are restricted. In particular, fingers and the thumb are free for holding other things for the convenience of the user (e.g., a water bottle). The wrist portion 120 also provides support to the wrist for comfort and safety protection during exercise.

Figure 3A:
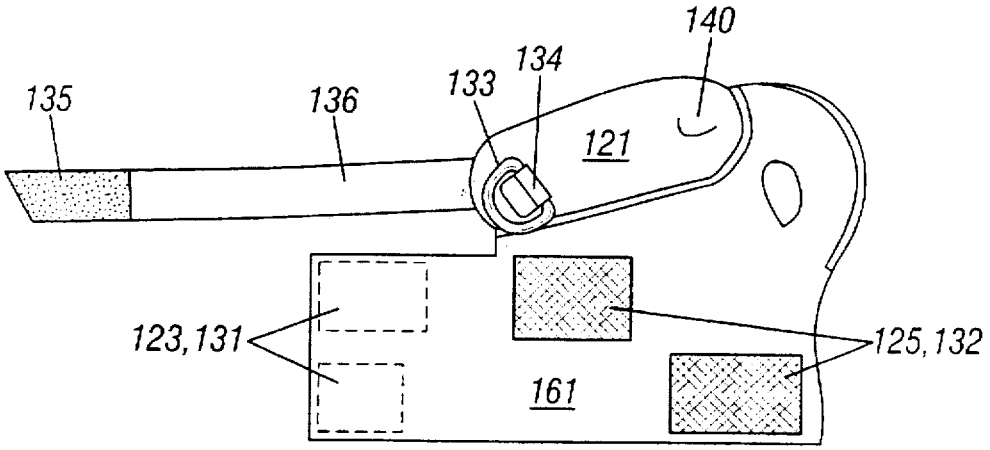
FIGS. 3*a*–3*c* show variations of the first preferred embodiment of FIG. 1.
Figure 3B:
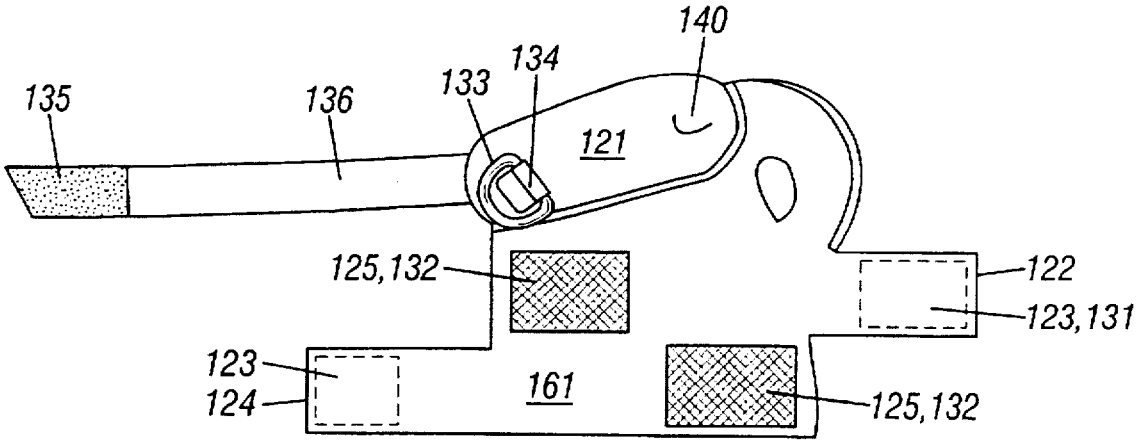
Figure 3C:
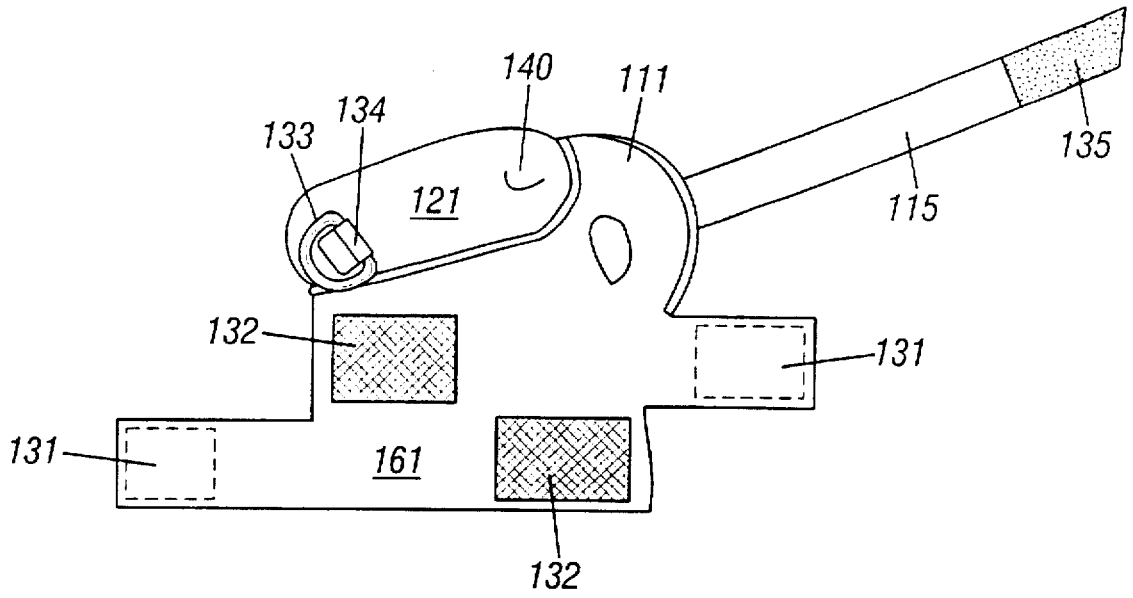

Many variations on the first preferred embodiment 100 can be made. FIG. 3*a* shows that the two straps 122 and 124 of FIG. 1 in the wrist portion 120 for wrist attachment can be combined as one piece 302 with VELCRO hook/loop fasteners. The two straps 122 and 124 of FIG. 1 in the wrist portion 120 for wrist attachment can also be made on different sides of the wrist portion 120 as illustrated in FIG. 3*b*. The strap 115 for palm attachment in the hand portion 110 can also be directly attached to the thumb attachment 111 as shown in FIG. 3*c*.

The inventor recognized that the adjustable fastening mechanism for both palm attachment and wrist attachment can be implemented with a variety of fastening means, including but not limited to, a strap in conjunction with hook/loop fasteners, buckles, D-rings, or a combination thereof.

Figure 4:
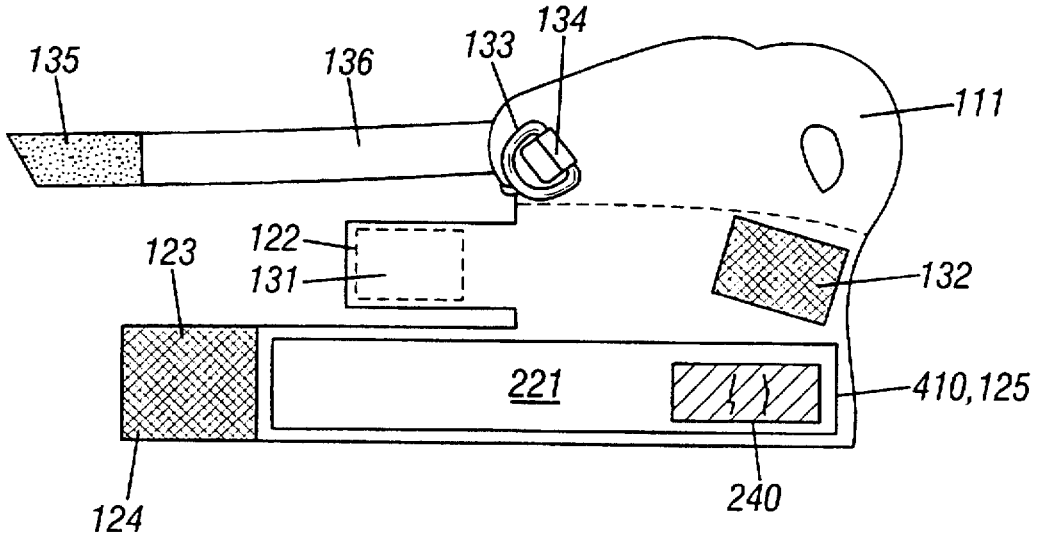
FIG. 4 shows the second preferred embodiment of the hands-free weight system with a wrist weight compartment (left hand only).

FIG. 4 shows a second preferred embodiment wherein a weight compartment 410 is located in the wrist portion 120. The amount of weights in the compartment 410 is adjustable to fit the user's needs.

Figure 5A:
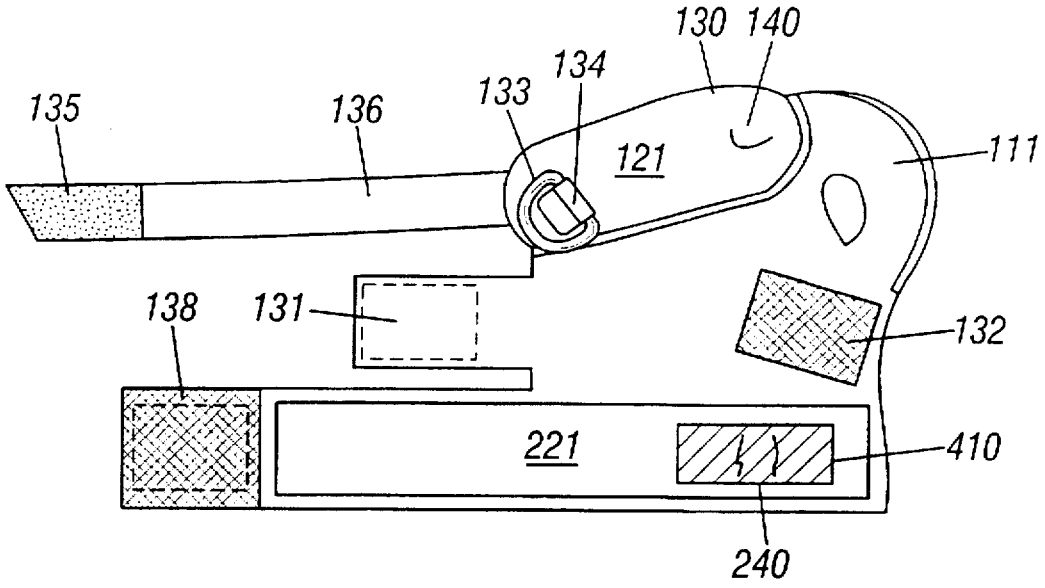
FIG. 5*a* shows the third preferred embodiment hands-free weight system with both the wrist weight compartment and the hand weight compartment (left hand only).
Figure 5B:
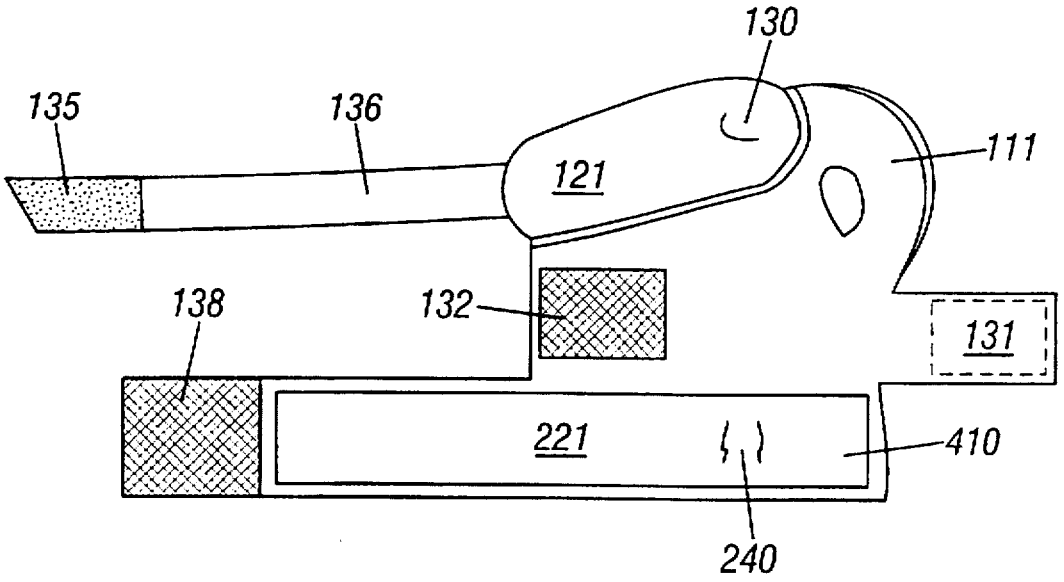
FIG. 5*b* shows a variation of the third preferred embodiment.

FIG. 5*a* shows a third preferred embodiment wherein two weight compartments are implemented, a hand weight compartment 130 located in the hand portion 110 and a wrist weight compartment 410 located in the wrist portion 120. FIG. 5*b* further shows the palm attachment and the wrist attachment are implemented directly with hook/loop fasteners. The surfaces of the weight compartments have loop materials upon which the straps with hooks are attached.

In addition, the thumb attachment in the hand portion of the above embodiments can be replaced with one or more finger attachments instead. A finger attachment can be made in a similar manner as the thumb attachment, e.g., either using a finger hole for anchoring or a finger strap with a fastening mechanism. The finger can be any of the four fingers, i.e., the index finger, the middle finger, the ring finger and the "pinky" finger. Alternatively, both a thumb attachment and one or more finger attachments can be made in the hand portion and operate in combination.

Although the present invention has been described in detail with reference to the preferred embodiments, one ordinarily skilled in the art to which this invention pertains will appreciate that various modifications and enhancements may be made without departing from the spirit and scope of the following claims.

What is claimed is:

1. An exercise device for attaching weights to a user, comprising:

a flexible supporting portion having a first surface that is adapted to a shape of at least a part of a hand thereby fitting said supporting portion to at least a part of said user's hand and wrist and a second surface opposing said first surface;

a hand portion formed in said supporting portion to fit on the back of said user's hand;

a first anchoring element formed in said hand portion, operable to anchor said supporting portion to a first member of said user's thumb and fingers, leaving said user's thumb and fingers free;

a palm attachment formed in said hand portion, operable for fastening said hand portion to said user's hand in a way that said user's fingers are free to move about;

a wrist portion formed in said supporting portion and connected to said hand portion;

a wrist attachment formed in said wrist portion, operable to fasten said wrist portion to said user's wrist; and a first weight compartment, disposed on said second surface of said supporting portion, operable to hold a first weight therein.

2. A device as in claim 1, wherein said first anchoring element is a thumb attachment.

3. A device as in claim 2, wherein said thumb attachment is formed by a thumb hole penetrating said supporting portion through said first and second surfaces, said thumb hole being located at a selected location in said hand portion.

4. A device as in claim 2, wherein said thumb attachment is formed by a flexible thumb strap having a fastening mechanism.

5. A device as in claim 1, wherein said first anchoring element is a finger attachment for any one of four fingers.

6. A device as in claim 5, wherein said finger attachment is formed by a finger hole penetrating said supporting portion through said first and second surfaces, said finger hole being located at a selected location in said hand portion.

7. A device as in claim 5, wherein said finger attachment is formed by a flexible finger strap having a fastening mechanism.

8. A device as in claim 1, further comprising a second anchoring element formed in said hand portion, operable to further anchor said supporting portion to a second member of said user's thumb and fingers, leaving said user's thumb and fingers free.

9. A device as in claim 1, wherein said palm attachment includes a fastener whose tightness is adjustable.

10. A device as in claim 9, wherein said fastener includes a strap connected to said hand portion at one end and having a combination of a hook and a loop at the other end, and a ring attached to said second surface of said hand portion, said ring allowing said strap to go therethrough.

11. A device as in claim 9, wherein said fastener includes a strap connected to said hand portion having a buckle, and a ring attached to said second surface of said hand portion, said ring allowing one end of said strap to go therethrough to form a lock with said buckle.

12. A device as in claim 1, wherein said wrist attachment includes a fastener whose tightness is adjustable.

13. A device as in claim 12, wherein said fastener includes a strap connected to said wrist portion at one end and having a combination of a hook and a loop at the other end, and a ring attached to said second surface of said wrist portion, said ring allowing said strap to go therethrough.

14. A device as in claim 12, wherein said fastener includes a strap connected to said wrist portion having a buckle, and a ring attached to said second surface of said wrist portion, said ring allowing one end of said strap to go therethrough to form a lock with said buckle.

15. A device as in claim 1, wherein said first weight compartment is located in said hand portion, providing a balanced weight distribution thereon.

16. A device as in claim 1, wherein said first weight compartment is located in said wrist portion, providing a balanced weight distribution thereon.

17. A device as in claim 16, further comprising a second weight compartment, disposed on said second surface of said supporting portion, operable to hold a second weight therein.

18. A device as in claim 17, wherein said second wight compartment is located in said hand portion, providing a balanced weight distribution thereon.

19. A device as in claim 1, wherein said first weight includes a plurality of weight sets with different amount of weight, making said first weight adjustable.

* * * * *